US006393842B2

(12) United States Patent
Kim et al.

(10) Patent No.: US 6,393,842 B2
(45) Date of Patent: May 28, 2002

(54) AIR CONDITIONER FOR INDIVIDUAL COOLING/HEATING

(75) Inventors: Cheol Min Kim, Kyonggi-do; Yoon Jel Hwang; Yun Ho Ryu, both of Seoul, all of (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/727,518

(22) Filed: Dec. 4, 2000

(30) Foreign Application Priority Data

Dec. 23, 1999 (KR) ..... 99-61207

(51) Int. Cl.[7] ..... F25B 21/02
(52) U.S. Cl. ..... 62/3.4; 62/3.3
(58) Field of Search ..... 62/3.4, 3.3

(56) References Cited

U.S. PATENT DOCUMENTS 4,400,948 A * 8/1983 Moorehead ..... 62/3
4,905,475 A * 3/1990 Tuomi ..... 62/3.3
5,413,166 A * 5/1995 Kerner et al. ..... 165/30
5,499,504 A * 3/1996 Mill et al. ..... 62/3.3
5,590,532 A * 1/1997 Bachmann ..... 62/3.3
5,921,088 A * 7/1999 Imaizumi et al. ..... 62/3.4

* cited by examiner

*Primary Examiner*—William Doerrler
*Assistant Examiner*—Mark Shulman
(74) *Attorney, Agent, or Firm*—Birch, Stewart, Kolasch & Birch, LLP

(57) ABSTRACT

Air condition for individual cooling/heating including a front compartment and a rear compartment separated by a partition plate made of an insulating material for forced inlet and outlet of external air therethrough respectively, at least two heat exchanger parts each in upper parts of the front and rear compartments and lower parts of front and rear compartments for making heat exchange with external air passing through the front compartment and the rear compartment respectively, first drawing means and second drawing means mounted in an upper portion or a lower portion of the front compartment or the rear compartment respectively for forced circulation of the external air through respective compartments, and driving means for driving the first and second drawing means, each of the heat exchanger parts includes thermoelectric modules each connected to a power source for absorbing heat at a heat absorptive part and discharging the heat from a heat dissipative part provided opposite to the heat absorptive part and heat exchangers each in contact either with the heat absorptive part or the heat dissipative part of the thermoelectric module for causing heat exchange between the air flowing into the front or rear compartment and the thermoelectric module, thereby providing individual cooling/heating to a user, and constant temperature dehumidification.

19 Claims, 4 Drawing Sheets

AIR CONDITIONER FOR INDIVIDUAL COOLING/HEATING

BACKGROUND OF THE INVENTION

1. Field of the Invention

The present invention relates to an air conditioner, and more particularly, to an air conditioner for individual cooling/heating, which can provide fresh cooling or heating air to users, individually.

2. Background of the Related Art

In general, a cooling/heating device is used for cooling/heating a room space, such as living rooms, restaurants, offices, or the like, of which operation will be explained with reference to FIG. 1.

A refrigerant gas compressed to a high pressure and a high temperature at a compressor 1 is provided to a first heat exchanger 2, and condensed into liquid as the refrigerant gas discharges heat to external air blown by a blower 3 on one side of the first heat exchanger 2. The external air, heated as it passes through the first heat exchanger 2, is discharged to the outside of the room. The refrigerant condensed at the first heat exchanger 2 is throttled and decompressed to a pressure low enough to easily vaporize the refrigerant as it passes through an expansion valve 4. The refrigerant is provided to a second heat exchanger 5, and absorbs external heat as it is vaporized by external air blown by a blower 6 on one side of the second heat exchanger 5. The external air, cooled as the external air passes through the second heat exchanger 5, is discharged into a room to cool down the room, and the liquid refrigerant is vaporized into a low pressure refrigerant gas at the second heat exchanger 5 and provided to the compressor 1 to again repeat the foregoing process until entire room is cooled down. In the meantime, if it is desired that the cooling/heating device is used for heating the room, the refrigerant is circulated in reverse. Then the second heat exchanger 5 works as a condenser, to make warm air to flow into the room, and, opposite to this, the first heat exchanger works as an evaporator to discharge cooled air out of the room.

However, the related art cooling/heating device has problems in that, as the related art cooling/heating device has a system to cool/heat an entire room space, neither the air provided by the related art cooling/heating device can satisfy all individual tastes of persons in the room, nor is the amount of air required for the air conditioning efficient. That is, it is known that though a rate of air required for respiration per one person is 0.133 l/s in view of physiology, a standard rate of conditioning air per one person is 10 l/s in a case of general air conditioning, that is, the rate of air required for respiration for one person is merely approximately 1% of the total conditioning air.

Since the related art cooling/heating device is of a bulky and heavy stationary type, which is difficult to carry, transmission of a cooling/heating effect to a region far from the cooling/heating device is poor, thus cooling/heating cannot be expected in a case when a person leaves the room where the cooling/heating is available and moves to a place where the cooling/heating is not available.

In the meantime, the dehumidified air, provided when the cooling/heating device is in a dehumidifying mode, may make people feel unpleasant as air temperature in the dehumidifying mode is too low if the external temperature is relatively low in the summer season, owing to rain and the like, because the air is cooled to a temperature lower than an external air temperature for dehumidification.

SUMMARY OF THE INVENTION

The present invention is directed to an air conditioner for individual cooling/heating that substantially obviates one or more of the problems due to limitations and disadvantages of the related art.

An object of the present invention is to provide an air conditioner for individual cooling/heating, which is portable and capable of providing cooling/heating air at a comfortable temperature and humidity to users in a room, individually.

Another object of the present invention is to provide an air conditioner for individual cooling/heating, which has a constant temperature dehumidifying function in which air can be dehumidified without dropping air temperature so much that air with a comfortable temperature and humidity cannot be provided to the users.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the air conditioner for individual cooling/heating includes a front compartment and a rear compartment, separated by a partition plate made of an insulating material for forced inlet and outlet of external air therethrough respectively, at least two heat exchanger parts each in upper parts of the front and rear compartments and lower parts of front and rear compartments for making heat exchange with external air passing through the front compartment and the rear compartment respectively, first drawing means and second drawing means mounted in an upper portion or a lower portion of the front compartment or the rear compartment respectively for forced circulation of the external air through respective compartments, and driving means for driving the first and second drawing means, each of the heat exchanger parts includes thermoelectric modules each connected to a power source for absorbing heat at a heat absorptive part and discharging the heat from a heat dissipative part provided opposite to the heat absorptive part, and heat exchangers each in contact either with the heat absorptive part or the heat dissipative part of the thermoelectric module for causing heat exchange between the air flowed into the front or rear compartment and the thermoelectric module, thereby providing individual cooling/heating to a user and constant temperature dehumidification.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENT

Figure 1:
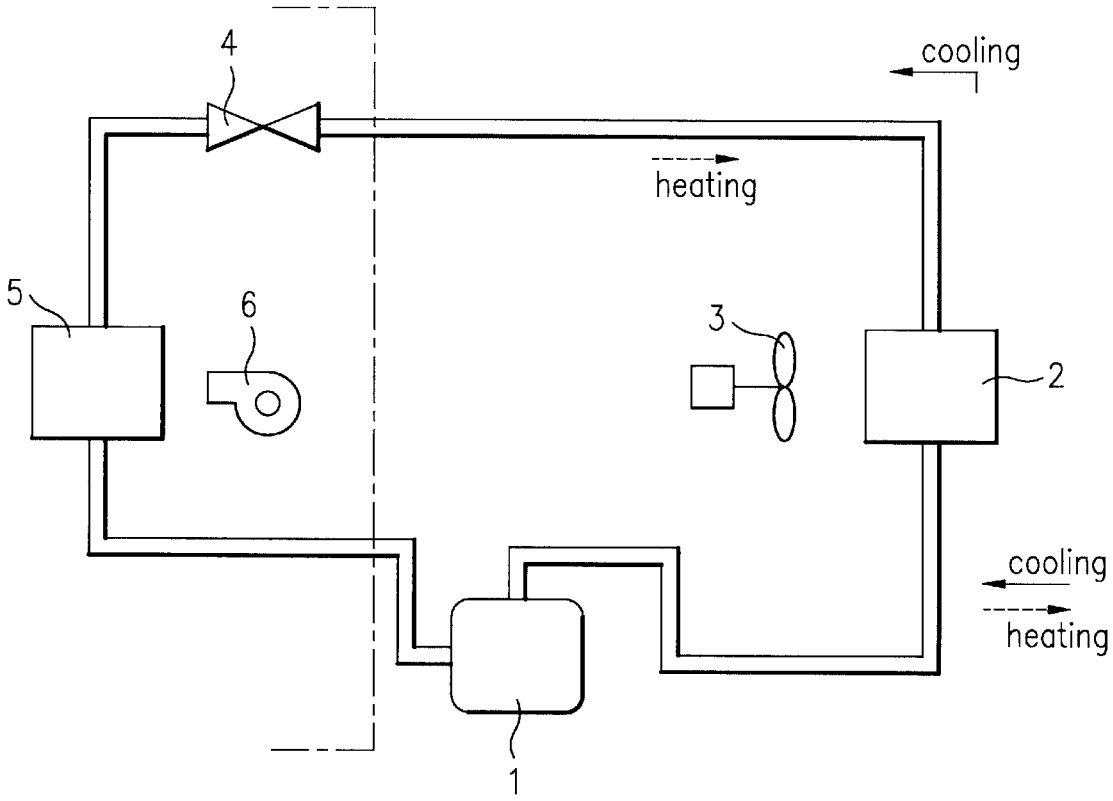
FIG. 1 Related Art
FIG. 1 illustrates a system of a related art cooling/heating device, schematically.
Figure 2:
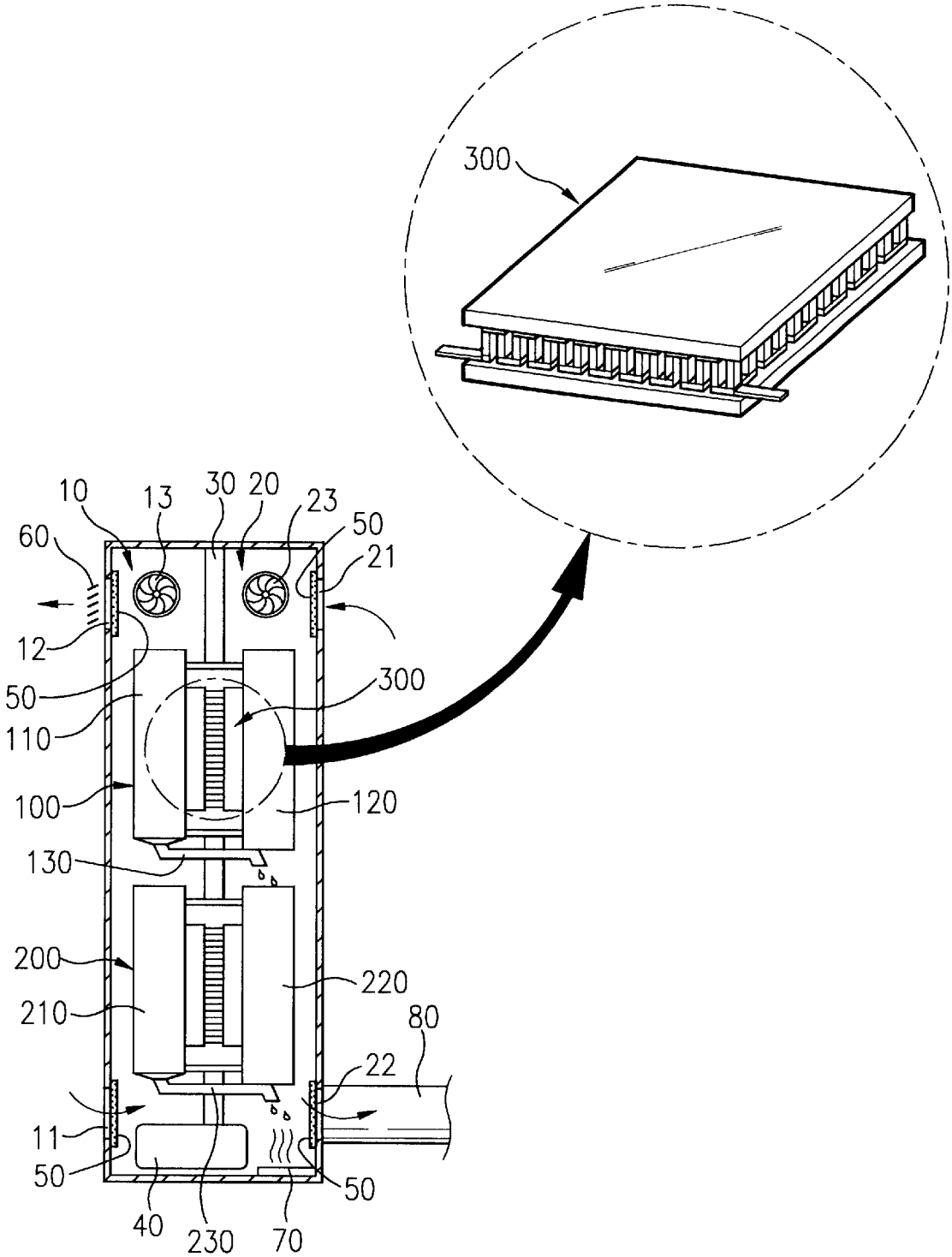
FIG. 2 illustrates a side section of an air conditioner for individual cooling/heating in accordance with a first preferred embodiment of the present invention, schematically.

Reference will now be made in detail to the preferred embodiments of the present invention, examples of which are illustrated in the accompanying drawings. For reference, in the following explanation, the left side of the device in the drawing is the front side of the device, and the right side of the device in the drawing is the rear of the device, and names of components explained below are given with reference to a cooling operation in which air discharged toward user is cooled air, which may be the opposite in a case of heating or constant temperature dehumidification, and not absolute definition of functions of the components. For example, an absorptive heat exchanger explained below absorbs heat during a cooling operation, the absorptive heat exchanger discharges heat, opposite to the heat absorption, during a heating operation. FIG. 2 illustrates a side section of an air conditioner for individual cooling/heating in accordance with a first preferred embodiment of the present invention, schematically.

Referring to FIG. 2, the air conditioner for individual cooling/heating in accordance with a first preferred embodiment of the present invention includes a front compartment 10, a rear compartment 20, a partition plate 30 of an insulating material for isolating the front compartment 10 and the rear compartment 20, a first heat exchanger part 100 in upper parts of the front compartment 10 and the rear compartment 20, and a second heat exchanger part 200 in lower parts of the front compartment 10 and the rear compartment 20. The first and second heat exchanger parts 100 and 200 have the same system, each inclusive of a thermoelectric module 300 connected to a power source 40 mounted on a bottom of the air conditioner for absorbing heat through a heat absorptive part and discharging the heat through a heat dissipative part by using electric power, an absorptive heat exchanger 110 or 210 in the front compartment 10 in contact with the heat absorptive part 10 in the thermoelectric module 300 for absorbing heat from, and cooling down air flowing into the front compartment 10, and dissipative heat exchanger 120 or 220 in the rear compartment 20 in contact with the heat dissipative part in the thermoelectric module 300 for discharging heat to air flowing into the rear compartment 20, to heat the air. That is, the two absorptive heat exchangers 110 and 210 are arranged in the front compartment 10 in upper and lower parts thereof, and the two dissipative heat exchangers 120 and 220 are arranged in the rear compartment 20 in upper and lower parts thereof, for cooling/heating the air flowed into the front or rear compartment 10 or 20 twice by the two heat exchangers, respectively. It is preferable that the heat exchangers 110, 210, 120, and 220 are plates formed of a material which is light with a good heat transfer coefficient, such as aluminum. And, the thermoelectric modules 300 are connected to the power source 40 at the bottom of the front or rear compartment 10 or 20 through a change-over switch (not shown) for selective change-over to an electrode of either thermoelectric modules 300 in the first heat exchanger part 100 or the second heat exchanger part 200. Accordingly, the air conditioner of the present invention makes, not only at a user's will selection of cooling/heating, but also makes a constant temperature dehumidifying function available. Moreover, there is a crossflow fan 13 or 23 in an upper part of each of the front compartment 10 and the rear compartment 20 for forced drawing and discharge of external air. Directions of air flows in the front compartment 10 and the rear compartment 20 are opposite to each other. For this, while there is a front air inlet 11 in a lower portion of front side of the front compartment 10 for drawing air, and a front air outlet 12 in an upper portion of front side of the front compartment 10 for discharging the air, there is a rear air inlet 21 in an upper portion of rear side of the rear compartment 20 for drawing air, and a rear air outlet 22 in a lower portion of rear side of the rear compartment 20 for discharging the air. There is a filter 50 fitted to an inside of each of the front air inlet 11 and the front air outlet 12 of the front compartment 10, and the rear air inlet 21 and the rear air outlet 22 of the rear compartment 20. The filters 50 may be fitted to the front and rear air inlets 11 and 21 or the front and rear air outlets 12 and 22, selectively. There is an air guide 60 detachably fitted to the front air outlet 12 of the front compartment 10 a direction of which can be adjusted in an up, down, left, or right direction for discharging the air cooled/heated as the air passes through the front compartment 10 to a desired direction.

In the meantime, there are condensed water pipes 130 and 230 fitted to bottoms of the absorptive heat exchangers 110 and 210 of the first heat exchanger part 100 and the second heat exchanger part 200, both in the front compartment 10, and led to the rear compartment 20 through the partition plate 30 for collecting, and guiding water drops condensed by cooling at the absorptive heat exchangers 110 and 210 during the cooling operation to a water receiving heater 70 on the bottom of the rear compartment 20, wherein a first water pipe 130 fitted to the bottom of the absorptive heat exchanger 110 of the first heat exchanger part 100 ends right over the dissipative heat exchanger 220 of the second heat exchanger part 200 in the rear compartment 20 so that the water drops guided through the first condensed water pipe 130 can be utilized as cooling water for cooling the dissipative heat exchanger 220 of the second heat exchanger part 200, and a second condensed water pipe 230 fitted to the bottom of the absorptive heat exchanger 210 of the second heat exchanger part 200 ends right over the water receiving heater 70 so that the water drops guided through the second condensed water pipe 230 is guided to the water receiving heater 70 directly for vaporizing the water drop. The water receiving heater 70 is connected to the power source for operation, and may be detachably fitted to the bottom of the rear compartment 20 or on an outside surface of the front air outlet 12 for receiving warmer air from the front air outlet 12 in heating.

The use of thermoelectric module as cooling/heating means, which can provide accurate temperature control, in the air conditioner of the present invention permits an accurate temperature control in a range of 20° C. ~23° C. which provides the most comfortable feeling to a human body. The air conditioner of the present invention can change a cooling mode into a heating mode simply by changing over the electrodes connected to the thermoelectric module 300, which converts the heat absorptive part into a heat dissipative part, and vice versa.

Figure 3:
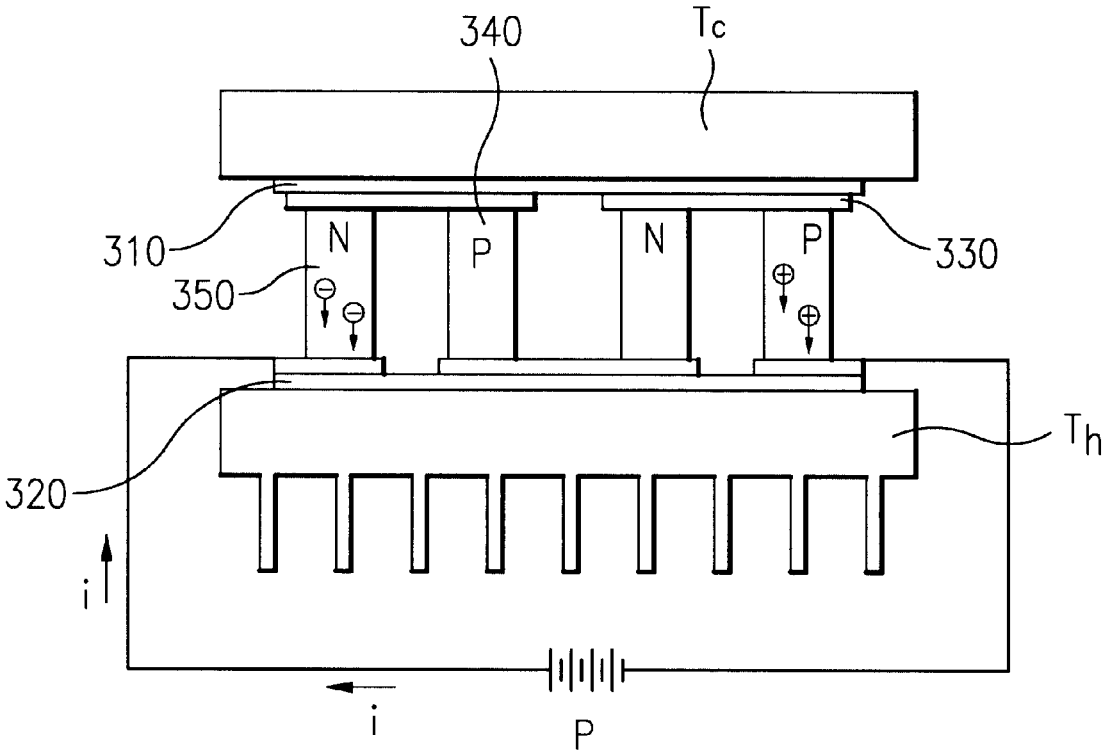
FIG. 3 illustrates an operation principle of a thermoelectric module employed in an air conditioner for individual cooling/heating of the present invention; and, FIG. 4 illustrates a side section of an air conditioner for individual cooling/heating in accordance with a second preferred embodiment of the present invention, schematically.

For reference, the system and operation principles of the thermoelectric module 300 will be explained. Being an electric element based on a semiconductor which acts as a solid state heat pump, the thermoelectric module employs the Peltier Effect, in which a current applied to an interface of two different materials connected in series causes heat absorption/dissipation in proportion to the current. As shown in FIG.3, the thermoelectric module 300 employed in the air conditioner of the present invention includes an upper ceramic plate 310, to be brought into contact with a substance Tc to be cooled by absorbing heat therefrom, a lower ceramic plate 320 to be brought into contact with a substance Th for discharging the heat thereto, 'p' type semiconductors 340 and 'n' type semiconductors 350 connected between the upper ceramic plate 310 and the lower ceramic plate 320 alternately, and electric alternative connection layers 330 of copper or the like each electrically connected to the 'p' type semiconductor 340 and the 'n' type semiconductor 350 alternately and connecting one ends of the 'p' type semiconductor 340 and the 'n' type semiconductor 350 to the upper ceramic plate 310 or the lower ceramic plate 320. The alternative connection layer 330 is connected to a DC power source 'P' for having a current flowing through the 'p' type semiconductor 340 and the 'n' type semiconductor 350. Accordingly, if a DC power is applied for cooling/heating the substance Tc by using the thermoelectric module 300, a current 'i' flows through the 'p' type semiconductor 340 and the 'n' type semiconductor 350 connected to the alternative connection layers 330 alternately, to cause electron(−) migration opposite to a flow direction of the current 'i' in the 'n' type semiconductor 350 and hole(+) migration in a direction the same with the flow direction of the current 'i' in the 'p' type semiconductor 340. That is, electrons(−) and holes(+) migrate from the upper ceramic plate 310 to the lower ceramic plate 320 through the 'n' type semiconductor 350 and the 'p' type semiconductor 340, causing the upper ceramic plate 310 to absorb heat and discharge the heat to the lower ceramic plate 320 such that the upper ceramic plate 310 acts as the heat absorptive part to cool down the substance Tc in contact with the upper ceramic plate 310, and the lower ceramic plate 320 acts as the heat dissipative part to heat the substance Th in contact with the lower ceramic plate 320. If polarities of the electricity connected to the thermoelectric module 300 are changed over, to change the flow direction of the current, i.e., if connections of a positive pole(+) and a negative pole(−) of the power source 'P' is changed over, opposite to the foregoing explanation, the heat is transmitted from the lower ceramic plate 320 toward the upper ceramic plate 310, converting the heat absorptive part into the heat dissipative part, and vice versa.

In summary, the thermoelectric module has the following features.

First, an accurate temperature control is possible as the absorbed/dissipated thermal energy is proportional to an intensity of a provided current.

Second, there is no noise or vibration from the air conditioner as there is no mechanical moving parts in the air conditioner.

Third, the air conditioner has a small size and light.

Fourth, local cooling/heating is possible.

Fifth, the air conditioner is friendly to the environment in that CFC gas or any other refrigerant gas is not used.

Sixth, a flow direction of the current determines heating or cooling mode.

The operation of the first embodiment air conditioner of the present invention will be explained.

In cooling, the air conditioner is operated, setting the air conditioner such that the ceramic plates 310 in the thermoelectric modules 300 of the first and second heat exchanger parts 100 and 200 in the front compartment 10 act as the heat absorptive parts, and the ceramic plates 320 in the rear compartment 20 act as the heat dissipative parts. Upon putting the crossflow fan 13 in the upper portion of the front compartment 10 into operation, external air flows into the front compartment 10 through the front air inlet 11 in the lower portion of the front compartment 10. Then, the air flowing through the front compartment 10 is cooled down the first time as the absorptive heat exchanger 210 in the second heat exchanger part 200 absorbs a heat from the air, rises upward, and cooled down a second time as the absorptive heat exchanger 110 in the first heat exchanger part 100 absorbs heat from the air, to cool down the air to a temperature suitable for the user, and discharged to the user through the front air outlet 12 in the upper portion of the front face of the air conditioner. At the same time, an air flow occurs in the rear compartment 20 in the direction opposite to a direction in the front compartment 10 by the crossflow fan 23 fitted in the upper portion of the rear compartment 20, i.e., external air flows into the rear compartment 20 through the rear air inlet 21 in the upper portion of the rear compartment 20, flows down to be heated at a first time as the dissipative heat exchanger 120 in the first heat exchanger part 100 dissipates heat thereto, and to be heated a second time as the dissipative heat exchanger 220 in the second heat exchanger part 200 dissipates heat thereto, and discharged through the rear air outlet 22 in the lower portion of the rear compartment 20, and to the outside of the room through a discharge duct 80 provided right after the rear air outlet 22. In the meantime, the water drops formed as the air passes through the absorptive heat exchangers 110 and 210 in the front compartment 10 are guided to the rear compartment 20 through the first and second condensed water pipes 130 and 230, wherein the water drops guided through the first condensed water pipe 130 are dropped onto the dissipative heat exchanger 220 of the second heat exchanger part 200, and evaporated while cooling down the dissipative heat exchanger 220, or a portion of the water drops left after the evaporation, dropped onto the water receiving heater 70 on the bottom of the rear compartment 20 and evaporated, and the water drops guided through the second condensed water pipe 230 is dropped onto the water receiving heater 70 directly, and evaporated therefrom.

Next, the heating operation of the first embodiment air conditioner of the present invention will be explained.

In the heating, the change-over switch (not shown) is operated to change the electrodes of the thermoelectric modules 300 in the first and second heat exchanger parts 100 and 200, for altering the heat dissipative part and the heat absorptive part. In this instance, the air conditioner can heat the room as the absorptive heat exchangers 110 and 210 in the front compartment 10 are made to be operative as dissipative heat exchangers which discharge a heat to the flowing air, and the dissipative heat exchangers 120 and 220 in the rear compartment 20 are made to be operative as absorptive heat exchangers which absorbs heat from the flowing air, thereby discharging warm air through the front air outlet 12 in the front compartment 10.

In the meantime, the air conditioner of the present invention also has a constant temperature dehumidifying function in which dehumidification can be carried out without dropping air temperature much, wherein, in a state the second heat exchanger part 200 is set to be operative at the same as the cooling mode, the change-over switch(not shown) connected to the thermoelectric module 300 in the first heat exchanger part 100 is operated to alter the heat absorptive part and the heat dissipative part in the first heat exchanger part 100, for operating the absorptive heat exchanger 110 in the first heat exchanger part 100 as a dissipative heat exchanger, and the dissipative heat exchanger as an absorptive heat exchanger. That is, the air flowing into the front compartment 10 through the front air inlet 11 in the lower portion of the front compartment 10 is involved in dehumidification as the air is cooled by the absorptive heat exchanger 210 in the second heat exchanger part 200, rises upward, is heated again by the absorptive heat exchanger 110 which acts as a dissipative heat exchanger at the present time, to an appropriate temperature, and discharged through the front air outlet 12, thereby achieving constant temperature dehumidification. Therefore, if dehumidification is required on a cool rainy day, this constant temperature dehumidifying function is selected to carry out dehumidification with the external temperature kept the same.

Figure 4:
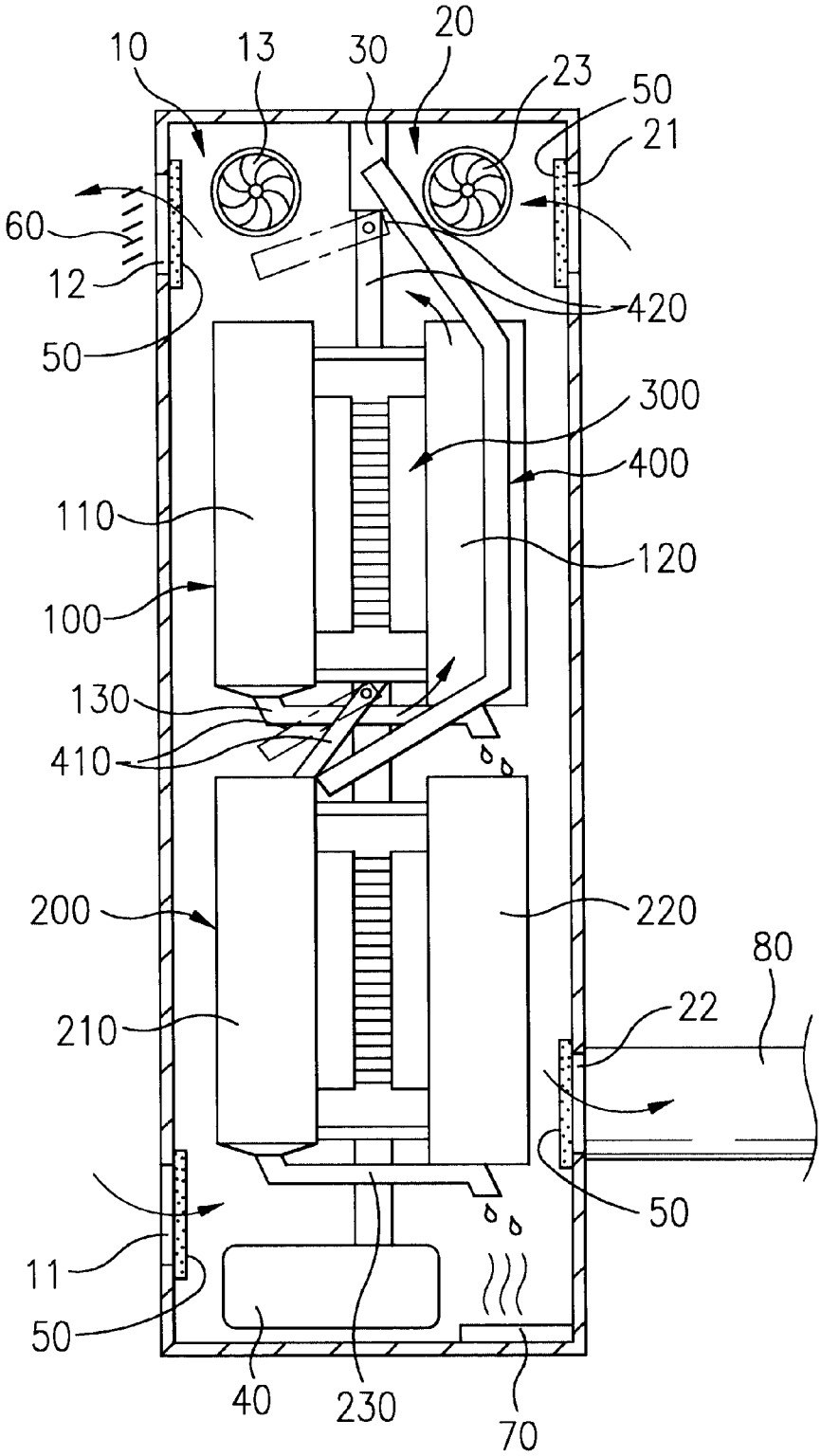

FIG. 4 illustrates a side section of an air conditioner for individual cooling/heating in accordance with a second preferred embodiment of the present invention schematically, of which system is almost the same as the first embodiment air conditioner except that the second embodiment air conditioner has an air flow path which is changeable for the constant temperature dehumidification function.

Referring to FIG. 4, there is an air flow passage 400 from the top of the absorptive heat exchanger 210 in the second heat exchanger part 200 to the partition plate 30 above the dissipative heat exchanger 120 through a portion of the dissipative heat exchanger 120. And, there is an inlet open/shut device 410 between an inner bottom side of the dissipative heat exchanger 120 in the first heat exchanger part 100 and an inner top side of the absorptive heat exchanger 210 in the second heat exchanger part 200 for opening/shutting an inlet to the air flow passage 400, and an outlet open/shut device 420 in the partition plate 30 above the first heat exchanger part 100 for opening/shutting an outlet from the air flow passage 400. It is preferable that both of the inlet and outlet open/shut devices 410 and 420 are operable by means of an electric-mechanical system which may be known. Accordingly, in room heating/cooling by using the air conditioner of the present invention, both of the inlet and outlet open/shut devices 410 and 420 are closed, and the room heating/cooling is conducted by a process the same with the first embodiment. However, in a case of constant temperature dehumidification, both of the inlet and outlet open/shut devices 410 and 420 are opened for the constant temperature dehumidification. Upon opening the air flow passage 400 by opening the inlet and outlet open/shut devices 410 and 420 for constant temperature dehumidification, air flows into the air flow passage 400 through the front air inlet 11 in the lower portion of the front compartment 10, and is dehumidified as the air is cooled at the absorptive heat exchanger 210 in the second heat exchanger part 200, one portion of which air rises upward above the second heat exchanger part 200 directly, and is cooled at the first heat exchanger part 100 as the air keeps rising passing through the first heat exchanger part 100, and the other portion of which air rises through the air flow passage 400, is heated as the air keeps rising through the dissipative heat exchanger 120 in the first heat exchanger part 100, and discharged through the outlet open/shut device 420 above the second heat exchanger part 200. Eventually, the air cooled at the first heat exchanger part 100 is involved in a temperature rise to a level almost similar to an external temperature as the cooled air is mixed with the heated air discharged through the outlet open/shut device 420 on the air flow passage 400, and discharged through the front air outlet 12, thereby achieving constant temperature dehumidification. As explained, the temperature of air discharged through the front air outlet 12 can be controlled by controlling voltage provided to the respective thermoelectric modules 300 of the first and second heat exchanger parts 100 and 200.

As has been explained, the air conditioner for individual cooling/heating of the present invention has the following advantages.

Since the employment of small thermoelectric modules as air conditioning means permits to fabricate air conditioners in a variety of sizes taking carriage and air conditioning capability into account, the air conditioner serves users better because only a space around the user can be cooled/heated intensively as the air conditioner can be easily placed anywhere the user likes.

The availability of accurate temperature control by the thermoelectric module permits the air conditioner of the present invention to control air temperature accurately.

The air conditioner of the present invention has no noise or vibration, and is easy to change from a cooling mode to a heating mode and vice versa as the mode conversion can be done by change-over of electrodes connected to the motors for driving the crossflow fans or the thermoelectric modules.

The constant temperature dehumidifying function can better serve users in that dehumidification can be achieved at a temperature similar to an external temperature in an environment in which the air temperature is low while the humidity is high, such as a rainy day.

It will be apparent to those skilled in the art that various modifications and variations can be made in an air conditioner for individual cooling/heating of the present invention without departing from the spirit or scope of the invention. Thus, it is intended that the present invention cover the modifications and variations of this invention provided they come within the scope of the appended claims and their equivalents.

What is claimed is:

1. An air conditioner for individual cooling/heating comprising:

a front compartment and a rear compartment separated by a partition plate made of an insulating material, for forced inlet and outlet of external air therethrough, respectively;

at least two heat exchanger parts, having four heat exchangers, one heat exchanger in each of the upper parts of the front and rear compartments and one heat exchanger in each of the lower parts of front and rear compartments for making multi-stage heat exchange with external air passing through the front compartment and the rear compartment, respectively, or alternating stages of heat exchange for dehumidification;

first drawing means and second drawing means mounted in an upper portion or a lower portion of the front compartment or the rear compartment respectively for forced circulation of the external air through respective compartments; and driving means for driving the first and second drawing means.

2. An air conditioner as claimed in claim 1, wherein each of the heat exchanger parts includes thermoelectric modules, each connected to a power source for absorbing heat at a heat absorptive part and discharging heat from a heat dissipative part provided opposite to the heat absorptive part.

3. An air conditioner as claimed in claim 1, wherein the air in the front compartment and the air in the rear compartment circulate in directions opposite to each other.

4. An air conditioner as claimed in claim 1, wherein the front compartment has an air inlet in a lower portion and an air outlet in an upper portion of a front surface thereof, and the rear compartment has an air inlet in an upper portion and an air outlet in a lower portion of a rear surface thereof.

5. An air conditioner as claimed in claim 4, further comprising filters for filtering contaminants from the air flowing into respective inlets of the front compartment and the rear compartment.

6. An air conditioner as claimed in claim 4, further comprising a blow direction guide detachably fitted to the air outlet of the front compartment for deflecting a discharge direction of the air discharged through the air outlet.

7. An air conditioner as claimed in claim 4, further comprising a discharge duct detachably mounted to the air outlet of the rear compartment for discharging air from the air outlet to the outside of a room that is being heated or cooled.

8. An air conditioner as claimed in claim 1, wherein the first and second drawing means are crossflow fans.

9. An air conditioner as claimed in claim 1, further comprising a condensed water pipe fitted to the bottom of a heat exchanger in the front compartment and passing through the partition plate into the rear compartment, for collecting, and channelling water condensed at the heat exchangers to the rear compartment.

10. An air conditioner as claimed in claim 9, further comprising collecting means at the bottom of the rear compartment for collecting water drops dropped through the condensed water pipe.

11. An air conditioner as claimed in claim 10, wherein the collecting means includes a heater for vaporizing the collected water drops.

12. An air conditioner as claimed in claim 11, wherein the heater is detachably fitted to the bottom of the rear compartment or to the air outlet of the front compartment.

13. An air conditioner as claimed in claim 2, wherein the heat absorptive part and the heat dissipative part of the thermoelectric module can be altered by change-over of the electrodes of the thermoelectric module connected to the power source.

14. An air conditioner as claimed in claim 2, wherein the thermoelectric modules are connected to the power source through a change-over switch for selective change-over of the electrodes connected thereto.

15. An air conditioner as claimed in claim 1, wherein the heat exchangers in the heat exchanger parts are formed of aluminum plate.

16. An air conditioner as claimed in claim 2, wherein constant temperature dehumidification by the air conditioner is made possible by changing-over the electrodes connected to the thermoelectric module disposed in the upper portion during cooling.

17. An air conditioner as claimed in claim 1, further comprising an air flow passage formed starting from a top of the heat exchanger in the lower heat exchanger part in the lower portion of the front compartment to the upper heat exchanger part in the front compartment through the partition plate between the heat exchanger parts, the heat exchanger in the upper heat exchanger part in the upper portion of the rear compartment, and the partition plate above the upper heat exchanger part.

18. An air conditioner as claimed in claim 17, wherein the air flow passage further includes an open/shut means at an inlet and outlet of the air flow passage for opening/shutting the air flow passage.

19. An air conditioner as claimed in claim 18, wherein the open/shut means is operable from outside of the air conditioner by an electrical device.

* * * * *